United States Patent [19]

Rossi et al.

[11] 4,029,586

[45] June 14, 1977

[54] LUBRICATING COMPOSITIONS INHIBITED AGAINST OXIDATION BY ADDITION THERETO OF 3-AZO-6A-THIO-THIOPHTHENES OR 3,4-DIAZO-6A-THIO-THIOPHTHENES

[75] Inventors: Enzo Rossi; Silvano Fattori, both of San Donato Milanese; Luigi Imparato, Milan, all of Italy

[73] Assignee: Snam Progetti, S.p.A., Milan, Italy

[22] Filed: Dec. 18, 1974

[21] Appl. No.: 533,955

[30] Foreign Application Priority Data

Dec. 20, 1973 Italy ..... 54483/73

[52] U.S. Cl. ..... 252/47.5; 252/47; 252/402

[51] Int. Cl.[2] ..... C10M 1/38

[58] Field of Search ..... 252/47, 47.5, 402

[56] References Cited

UNITED STATES PATENTS

| | | | |
|---|---|---|---|
| 2,612,504 | 9/1952 | Emerson et al. | 252/47 X |
| 2,910,439 | 10/1959 | Fields | 252/47 X |
| 3,228,952 | 1/1966 | Reifschneider | 252/47 X |
| 3,282,951 | 11/1966 | Spivack et al. | 252/47.5 X |
| 3,316,209 | 4/1967 | Spivack et al. | 252/47.5 X |
| 3,869,395 | 3/1975 | Waldbillig | 252/47 |
| 3,896,050 | 7/1975 | White | 252/47 X |
| 3,904,537 | 9/1975 | Ripple | 252/47 X |

*Primary Examiner*—Delbert E. Gantz
*Assistant Examiner*—Andrew H. Metz
*Attorney, Agent, or Firm*—Ralph M. Watson

[57] ABSTRACT

A mineral or synthetic lubricating oil is protected against oxidation by dissolving therein, at a temperature not higher than 80° C, a 3-aza-6a-thio-thiophthene or a 3,4-diaza-6a-thio-thiophthene represented by the general formulae:

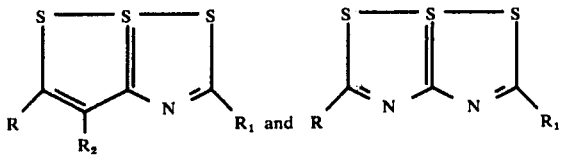

wherein, R, $R_1$ and $R_2$, the same or different, represent hydrogen, alkyl, cycloalkyl, aryl, alkylaryl, arylalkyl or aminoaryl.

7 Claims, No Drawings

LUBRICATING COMPOSITIONS INHIBITED AGAINST OXIDATION BY ADDITION THERETO OF 3-AZO-6A-THIO-THIOPHTHENES OR 3,4-DIAZO-6A-THIO-THIOPHTHENES

The invention relates to the inhibition of the oxidation of lubricating compositions, achieved by means of particular additives which exhibit properties far superior to those possessed by the additives normally used by those skilled in the art. It is well known that the high temperatures developed in the modern engines favour the oxidation of the lubricants and the formation of acid products which cause the corrosion of the metal surfaces with which they come into contact.

Furthermore, these products of oxidation are deposited, both as pitch products or varnishes and as lacquers on said metal surfaces of the engines, thus causing a decrease of the efficiency of the engine itself.

For the purpose of eliminating these undesirable effects as much as possible, there are usually added to the lubricants the so called anti-oxidant additives, such as the phenols sterically hindered, the aromatic amines, the alkyl phenol sulphides, the dialkylphosphonates, of Ca, Ba and Al and many others.

But the inconveniences of oxidation are not thus eliminated in a satisfactory way.

And for this reason it is an object of this invention to supply a new class of additives for lubricants capable of inhibiting the oxidation of the same in a more effective way than has been effected by the inhibitors of oxidation of the prior art.

A further object is the supplying of additives inhibiting oxidation for a wider range of products, such as lubricating compositions containing mineral oils obtained from the most different crudes, refined through acids or solvents or coming from hydrocracking; said additives being also suitable to inhibit from oxidation lubricating compositions containing synthetic bases such as synthetic hydrocarbons, synthetic esters, silicons, hydrogenated polyolefins, polyalkylene oxides, alkylbenzenes, phosphoric acids esters and others.

Now it has been found that the above objects and others, which will become evident in the course of the present specifications, are obtained through the use of the derivatives of 3-aza-6-thio-tiophthene and of 3,4-diaza-6a-thio-thiophthene, which are capable of giving the lubricating compositions a resistance against oxidation which is certainly better than any obtained with other known oxidation inhibitors.

The derivatives of 3-azo-6 a -thio-thiophthene and of 3,4-diazo-6 a -thio-thiophthene can be represented by the following general formulae:

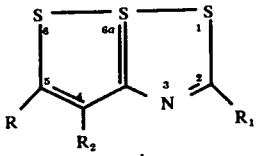

and

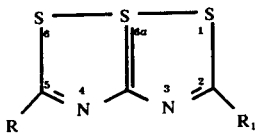

wherein R, $R_1$ and $R_2$ the same or different, represent a hydrogen atom or an alkyl, cycloalkyl, aryl, alkylaryl, arylalkyl or amino-aryl group.

Said antioxidizing additives dissolve with heat into the lubricating fluid at a temperature not higher than 70–80° C.

The quantity of the employed azo-thio-thiophthene or the diazo-thio-thiophthene depends on many factors such as the nature of the base and the presence of other additives.

The use of these additives is particularly advantageous since they are efficacious even at very low concentrations in the region of 0.01% or less.

Generally the azo-thio-thiophthenes or the diazo-thiothiophthene are used in concentrations which range from 0.001% to 10% by weight and preferably from 0.01 to 5% by weight.

The lubricants containing the antioxidizing agents of the invention can also contain various other types of additives normally used, such as detergents, dispersants, corrosion inhibitors and anti-rust, Viscosity Index improvers, sludge inhibitors, "pour point depressant" and even other anti-oxidizing agents, when it is desired to improve the characteristics of the inhibition against oxidation of compositions already containing anti-oxidizing agents.

The preparation of the azo-thio-thiophthene or of the diazo-thio-thiophthene derivatives of the present invention is, in general, known to those skilled in the art.

For instance, the method described by Hans Behringer et alii Chem. Ber. 97, 2567 (1964) - Chem. Ber. 100, 4027 (1967) can be enmployed.

For the purpose of illustrating the invention in a better way and to show its advantages the following examples are reported which however are not interpreted as limitative of the same.

EXAMPLE 1

In a flask provided with a cooler we placed 1.3 g of 3-amino-5-phenyl-1,2 dithiolium chloride, 2 ml of phenylisothiocyanate and 200 ml of toluene. We left it to boil with refluxing during about 12 hours, then we filtered and a part of the solvent was evaporated and then it was cooled. In this way 1,7 g of 2-aniline-5-phenyl-3-azo-6a-thio-thiophthene crystallized. Melting point: 168°–169° C (lit. 169°–171° C).

EXAMPLE 2

By operating under the conditions of the Example. 1 starting from 3-amino-5 phenyl-1,2 dithiolium chloride and p methoxy-phenyl-isothiocyanate the 2- [p-methoxy-aniline] -5-phenyl-3-aza-6a-thio-thiophthene was prepared. Melting point 210°–213° C (lit. 212° – 214° C).

EXAMPLE 3

By operating under the conditions of the Example. 1 from 3-amine-5 p. tolyl -1,2-dithiolium chloride and phenylisothiocyanate the 2-aniline-5- [p-tolyl] -3-azo-6a-thio-thiophthene was prepared. Melting point 206° C (lit. 206°–207° C).

EXAMPLE 4

8 g of phenylthiourete 8 ml of phenylisothiocyanate in 25 ml of xylene were heated in a flask at 150° C, during about 2 hours. At the end it was cooled, the precipitate was filtered, washed with ether and dried.

In this manner the 2,5 di-aniline-3,4-diazo-6a-thio-thiophthene was obtained. Melting point 197°–212° C (lit. 193°–211° C).

EXAMPLE 5

Under the same conditions as example 4 starting from p-methoxy-phenylthiourate and p. methoxy-phenylisothiocyanate was prepared the 2,5-bis [p.-metoxyaniline] -3,4-diaza-6a thio-thiophthene. Melting point 218° – 223° C (lit. recrystalized from glacial acetic acid, 226,5° – 227° C).

EXAMPLE 6

For the purpose of evaluating the antioxidizing properties of the derivatives of the diazo-thio-thiophthenes and azo-thio-thiophthenes in lubricating compositions, some tests of oxygen absorption were carried out.

This test was carried out in an apparatus of the type described by G. Miliotis and cooperators (Bull. Soc. Chim. France 1969; 847) and it consists in determining the oxidation induction period of a product maintained under a strong stirring in a thermostated reactor.

The reactor filled with oxygen, was connected to a graduated burette for gas also filled up with gas.

A differential manometer indicates the absorption of oxygen.

The tests were carried out at 160 ± 0.2° C on samples of 10 ml using as catalyst copper powder in the amount of 50 mg.

The products of the invention were dissolved in paraffinic mineral oil of viscosity production SAE 30.

The results were reported in Table 1.

TABLE 1

| No. Test | Additive | Conc. Moles/ liter | Induction period min. |
|---|---|---|---|
| 1 | none | — | 14 |
| 2 | 2,6-di-t.butyl-4-methyl-phenol | $10^{-2}$ | 270 |
| 3 | 2-aniline-5-phenyl-3-azo-6a-thio-thiophthene | $10^{-2}$ | 396 |
| 4 | 2-[p.methoxy-aniline]-5-phenyl-3-azo-6a-thio-thio-phthene | $10^{-2}$ | 415 |
| 5 | 2-aniline-5-[p.tolyl]-3-azo-6a-thio-thiophthene | $10^{-2}$ | 372 |
| 6 | 2,5-di-aniline-3,4-diazo-6a-thio-thiophthene | $10^{-2}$ | 505 |
| 7 | 2,5-bis[p.methoxy-aniline]-3,4-diazo-6a-thio-thiophthene | $10^{-2}$ | 490 |

EXAMPLE 7

With the apparatus and the steps described in example 2 the additives of the invention dissolved in trimethyl adipate of octyl gave as results the ones reported in Table 2.

TABLE 2

| No. | Additive | Conc. Moles/ liter | Induction period min. |
|---|---|---|---|
| 1 | None | — | 4 |
| 2 | pheny-α-naphthylamine | $3,5.1^{-3}$ | 124 |
| 3 | 2-aniline-5-phenyl-3-azo-6a-thio-thiophthene | $3,5.10^{-3}$ | 216 |
| 4 | 2-[p.methoxy-aniline]-5-phenyl-3-azo-6a-thio-thiophthene | $3,5.10^{-3}$ | 235 |

TABLE 2-continued

| No. | Additive | Conc. Moles/ liter | Induction period min. |
|---|---|---|---|
| 5 | 2-aniline-5[p.tolyl]-3-azo-6a-thio-thiophthene | $3,5.10^{-3}$ | 207 |
| 6 | 2,5-di-aniline-3,4-diazo-6a-thio-thiophthene | $3,5.10^{-3}$ | 365 |
| 7 | 2,5-bis[p.methoxy-aniline]-3,4-diazo-6a-thio-thiophthene | $3,5.10^{-3}$ | 320 |

The derivatives of the diazo-thio-thiophthene and azothio-thiophthenes can advantageously be used in oils for engines and for gears in various hydraulic fluids and for gearing in industrial and marine oils.

From Tables 1 and 2 it is possible to note that the compounds of the invention are considerably better than the well known commercial antioxidizing agents such as 2,6 di-t.-butyl-4-methyl-phenol and the phenyl-α-naphthyl-amine. Said derivatives of the aza-thio-thiopthenes and diaza-thio-thiophtenes particulary as already reported prevent the oxydation of different bases of lubricating oils at the high temperature and achieve the objects of the invention both from the point of view of the best activity as antioxidizing agents with respect to the conventional antioxidizing agents and from the point of view of their flexibility for use as antioxidizing agents in the range of lubricating products already mentioned.

What we claim is:

1. A lubricating composition inhibited against oxidation, comprising a mineral or synthetic oil having dissolved therein an antioxidant amount of an additive selected from the group consisting of the 3-azo-6a-thio-thiophthenes and 3,4-diazo-6a-thio-thiophthenes, represented by the general formulae;

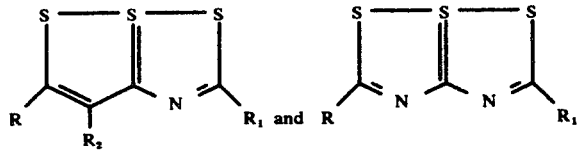

wherein R, $R_1$ and $R_2$, the same or different, represent a member of the group consisting of hydrogen, alkyl, cycloalkyl, aryl, alkylaryl, arylalkyl, and aminoaryl and p-methoxy-anilino.

2. A lubricating composition as claimed in claim 1, wherein said additive is contained in an amount in the range of from 0.001 to 10% by weight.

3. A lubricating composition as claimed in claim 1, wherein said additive is 2-aniline-5-phenyl-3-azo-6a-thio-thiophthene.

4. A lubricating composition as claimed in claim 1, wherein said additive is 2 (p. methoxy-aniline)-5-phenyl-3-azo-6a-thio-thiophthene.

5. A lubricating composition as claimed in claim 1, wherein said additive is 2-aniline-5-(p.tolyl)-3-azo-6a-thio-thiophthene.

6. A lubricating composition as claimed in claim 1, wherein said additive is 2,5-di-aniline-3,4-diazo-6a-thio-thiophthene.

7. A lubricating composition as claimed in claim 1, wherein said additive is 2,5-bis-(p. methoxy-aniline)-3,4-diazo-6a-thio-thiophthene.

* * * * *